US005560164A

United States Patent [19]

Ahrens

[11] Patent Number: 5,560,164

[45] Date of Patent: Oct. 1, 1996

[54] INSIDE SHIELDS FOR WINDOWS

[76] Inventor: Robert G. Ahrens, 2850 Somerset Dr., Apt. 207L, Ft. Lauderdale, Fla. 33311

[21] Appl. No.: 307,160

[22] Filed: Sep. 16, 1994

Related U.S. Application Data

[63] Continuation-in-part of Ser. No. 181,812, Jan. 18, 1994, abandoned.

[51] Int. Cl.[6] ..... E06B 5/12; E06B 9/02

[52] U.S. Cl. ..... 52/202; 52/766; 52/768; 52/745.15; 49/62; 49/463

[58] Field of Search ..... 52/202, 208, 798.1, 52/204.62, 204.64, 204.65, 204.66, 766, 767, 768, 741.3, 745.15, 745.16, 741.4, 741.1; 49/501, 503, 61, 62, 63, 67, 463

[56] References Cited

U.S. PATENT DOCUMENTS

| | | | |
|---|---|---|---|
| 2,631,698 | 3/1953 | Buckwalter | 49/62 |
| 2,722,272 | 11/1955 | Sprinkle | 49/463 |
| 2,878,536 | 3/1959 | Becker | 52/202 |
| 3,214,879 | 11/1965 | Ellingson, Jr. et al. | 52/202 |
| 3,296,763 | 1/1967 | Curl | 52/204.64 |
| 4,203,256 | 5/1980 | Mowry | 49/62 |
| 4,287,683 | 9/1981 | Louwenaar | 52/202 |
| 4,685,261 | 8/1987 | Seaquist | 49/463 |
| 5,067,278 | 11/1991 | Lyons | 49/463 |
| 5,343,668 | 9/1994 | Gonzalez | 49/463 |

*Primary Examiner*—Michael Safavi
*Attorney, Agent, or Firm*—Oltman and Flynn

[57] ABSTRACT

Interior shields for protecting structure openings such as windows and doors are described. The shields which are to be positioned on the inside of a window include metal pane backing, metal reinforcement channel members, a metal flange frame, and sealing gasket material on the inside edges of the flange frame. The shields are held in place by compressive fasteners that include a metal cam type wheel with a flat side portion, an axial-hole off center and a side opening for an adjustment rod. A bolt can fit through the axial opening to hold the wheel against the side interior frame of a window. The bolt can be held in place by a concrete anchor and metal sleeve. Rotating the adjustment rod attaches and detaches the shield from the window. When attached, the gasket material forms a watertight seal between the shield and the window. For wooden frames a lag bolt can be substituted for the bolt. Materials for the shield and compressive fastener can include aluminum, stainless steel, galvanized steel or the like. A second embodiment for using the shield with double windows is disclosed wherein two shields can be bolted together side by side. A third embodiment includes overlaying novel shield panels that do not have side flanges nor reinforcing members. These alternative shield panels can include a roll formed raised corrugated metal panel which overlies a moulded seal-gasket backing material, a rolled formed metal panel with a surface having parallel curved indentations formed from like material overlying a moulded seal-gasket backing material, an extruded corrugated plastic panel, and a sheet moulded fiberglass layer panel overlying a seal-gasket backing material. Each of the alternative shield panels of the third embodiment can be attached and compressed to the inside of the door and window opening in the same manner as described in the first embodiment. Using this invention limits the damage caused by storms to be generally limited to replacing window glass. It is a small matter to replace glass after a storm compared to damage done by wind and water entering an opening during a storm.

14 Claims, 4 Drawing Sheets

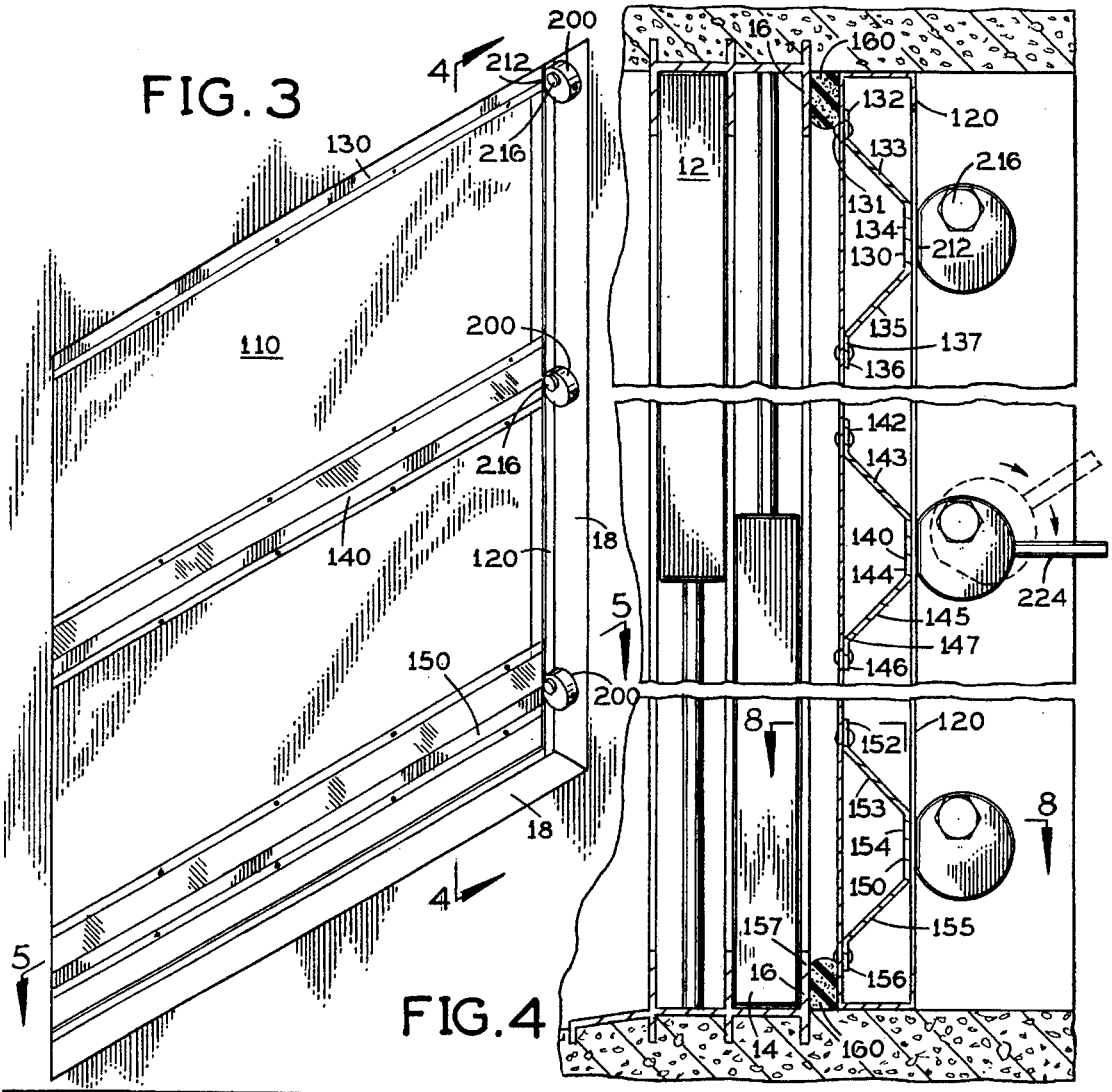
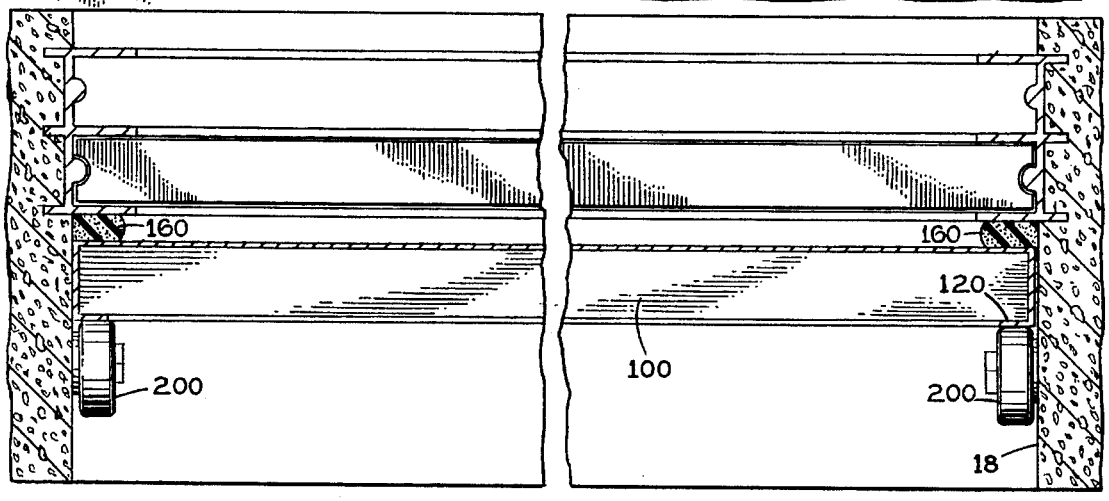
FIG. 5

700
710
711
712
713
714
715
716
717
718
719
720

800
810
850

400
410
412
414
416
450
452
454
456
A
B 500
510
512
514
516
550
552
554
556
C
D

INSIDE SHIELDS FOR WINDOWS

This application is a continuation in part of U.S. application Ser. No. 08/181,812 filed on Jan. 18, 1994, now abandoned. This invention relates to window shields, and in particular to novel shield panels that can be attached to the inside of windows for protection from storms and as a security device.

BACKGROUND AND PRIOR ART

Storm damage from hurricane Andrew caused billions of dollars in property damage. Much of the damage from storms such as a hurricane occur from flying debris and water crashing through windows and causing damage inside of the structures.

Homeowners abandoning their homes before a storm also leave a security risk since vandals and thieves can break into the homes. Also merely leaving ones home for a vacation poses a security risk as well.

In the past people have boarded up homes before dangerous storms. But this can cause damage to the homes by having to nail boards onto the outside of the homes and then later having to remove those boards.

Various types of outside shields that have been used can be very expensive. U.S. Pat. No. 3,516,470 to Kurz shows an exterior shield comprising blades that can be raised or lowered over windows. Variations of roll down shields are known. Typical costs for a lowerable shield can be $450 to 750 for a typical average window of 37 by 50 inches. The motor to operate the rolldown shield can alone cost an additional $200 to 400. Window shields that apply to the outside of windows can cost $200 to 400 for the same window size.

An additional problem is that these window shields can be difficult and time consuming to apply before a coming storm. For example it would be impossible for homeowners of high rise condominiums to go outside in order to put up one of these outside shields.

Further, additional problems with these outdoor shields is that many of these shields must be left in place in order to be used and can create an unsightly appearance. For example, rolling shields may have large rollers left in position above windows when not in use.

SUMMARY OF THE INVENTION

The first objective of the present invention is to provide a shield for windows that can easily inserted by a homeowner.

The second object of this invention is to provide a shield for windows that is less expensive than current window shields.

The third object of this invention is to provide a shield that can be used in highrise structures.

The fourth object of this invention is to provide a shield for inserting on the inside of windows.

The fifth object of this invention is to provide a shield that seals against existing windows and prevents water from entering through that window.

The sixth object of this invention is to provide a shield for security protection.

The seventh object of this invention is to provide a shield for protection from storm damage.

The eighth object of this invention is to provide a shield that can be easily applied at a moments notice.

The ninth object of this invention is to allow the shield to be removed out of sight when not in use.

The tenth object of this invention is to provide a shield that can be used for protecting any exterior openings in both commercial and residential structures.

A first embodiment of the shield can include metal pane backing, metal reinforcement channel members, a metal flange frame, and sealing gasket material on the inside edges of the flange frame. The shields can be held in place by compressive fasteners that include a metal cam type wheel with a flat side portion, an axial-hole off center and a side opening for an adjustment rod. A bolt can fit through the axial opening to hold the wheel against the side interior frame of a window. The bolt can be held in place by a concrete anchor and metal sleeve. Rotating the adjustment rod attaches and detaches the shield from the window. When attached, the gasket material forms a watertight seal between the shield and the window. For wooden frames a lag bolt can be substituted for the bolt. Materials for the shield and compressive fastener can include aluminum, stainless steel, galvanized steel or the like.

A second embodiment for using the shield with double windows can include two shields bolted together side by side.

A third embodiment includes overlaying novel shield panels that do not have side flanges nor reinforcing members. The shield panels can include: a roll formed raised corrugated metal panel formed from aluminum, stainless steel, galvanized steel and the like which overlies a moulded seal-gasket backing material; a rolled formed metal panel with a surface having parallel curved indentations formed from like material overlying a moulded seal-gasket backing material; a panel formed from extruded corrugated plastic; and a sheet moulded fiberglass layer panel overlying a seal-gasket backing material. Each of the novel shield panels can be attached to the inside of the door and window in the same manner as described in the first embodiment.

Further objects and advantages of this invention will be apparent from the following detailed description of a presently preferred embodiment which is illustrated schematically in the accompanying drawings.

BRIEF DESCRIPTION OF THE FIGURES

FIG. 3 illustrates a view of the fastener of FIG. 2 attaching the shield to the window of FIG. 1.

FIG. 4 illustrates a cross-sectional view along line 4 of FIG. 3.

FIG. 5 illustrates a cross-sectional view along line 5 of FIG. 3.

DESCRIPTION OF THE PREFERRED EMBODIMENT

Before explaining the disclosed embodiment of the present invention in detail it is to be understood that the invention is not limited in its application to the details of the particular arrangement shown since the invention is capable of other embodiments. Also, the terminology used herein is for the purpose of description and not of limitation.

FIRST EMBODIMENT.

Figure 1:
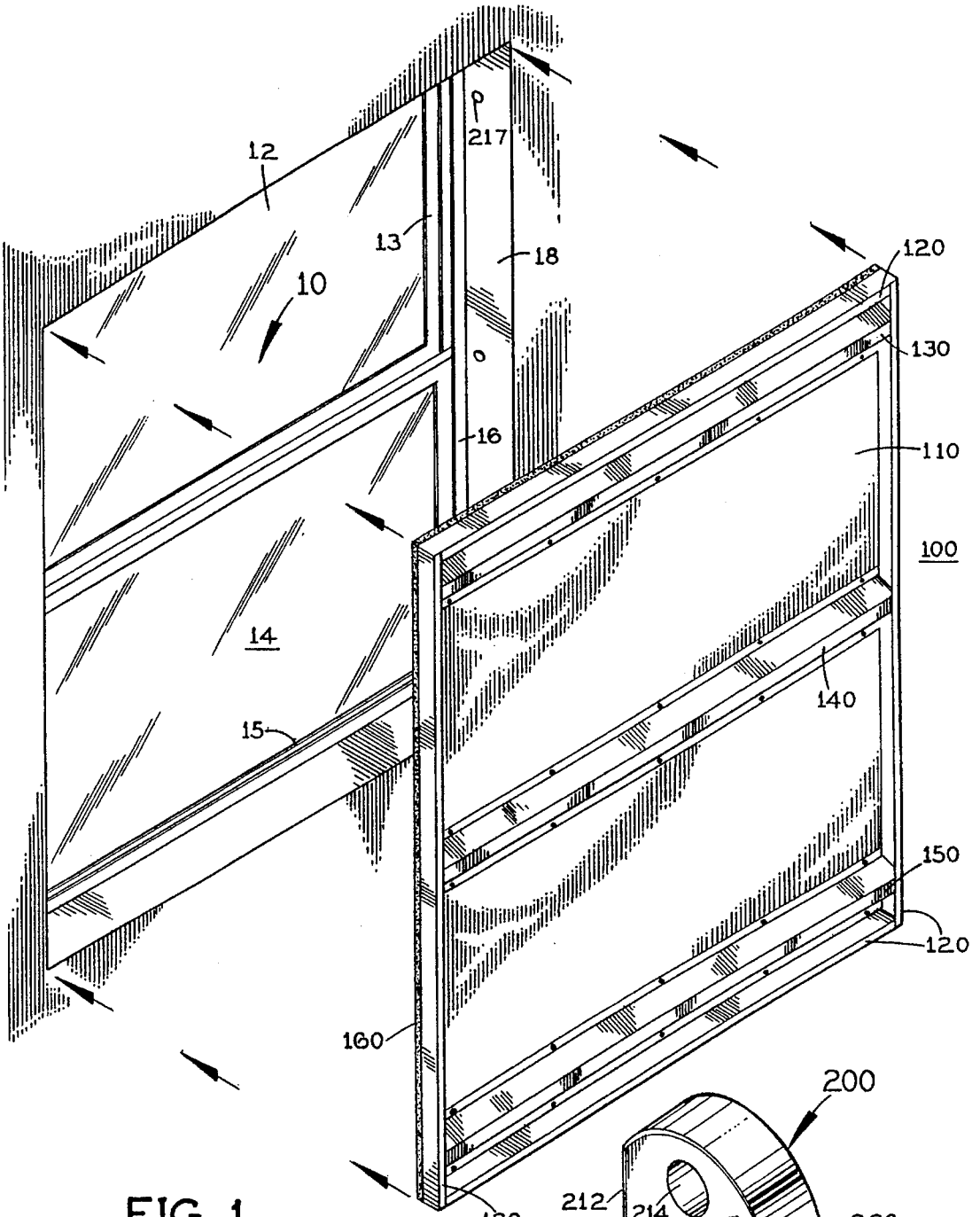
FIG. 1 illustrates an exploded view of the inside shield detached from the window to be protected.

FIG. 1 illustrates an exploded view of the inside shield 100 detached from a window 10 that is to be protected. A typical window is approximately 37 by 50 inches and includes top glass panel 12 within a glass frame 13, and a lower glass panel 14 within a lower frame 15, The frames 13 and 15 are typically raisable and lowerable, and include a first interior frame portion 16, which extends parallel to the glass panes 12 and 14 facing toward the interior of the window 10. A second interior frame 18 is located peripherally about the window 10 and is perpendicular to the first interior frame portion 16. Holes 217 are formed in the second interior frame for holding compressive fasteners 200 in place and will be described in more detail in FIG. 8.

In FIG. 1, interior shield 100 includes a pane backing 110 with parallel reinforcement channel members 130, 140, 150 across one side of the pane backing 110. Reinforcement channel members 130, 140 and 150 will be described in detail in FIG. 4 and 9. The pane backing 110 and channel members 130, 140, and 150 are surrounded by a raised flange frame 120. Raised flange frame 120 is shown more clearly in FIG. 9. For the preferred embodiment, the flange extends approximately one inch from pane backing 100. All components in the interior shield 100 can be formed from aluminum of 0.050 to 0.060 inch thickness, or 18 to 20 gage galvanized steel or the like. The shield 110 further includes a sealing material 160 of approximately ¾ inch width and thickness on the outer edges of the pane backing 110 facing toward the window 10. Sealing material 160 can be a closed cell gasket material of a rubber, silicone, or a type of known weather stripping or the like. The length and width of shield 110 are sized to be slightly smaller than the interior dimensions within the second interior window frame 18. For example if frame 18 is 37 by 50 inches, then the shield 110 has a length slightly less than 50 inches and a width slightly less than 37 inches.

Figure 2:
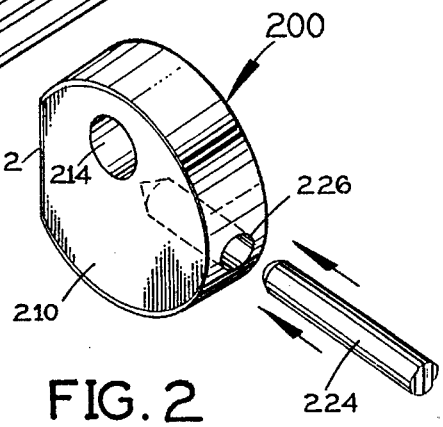
FIG. 2 illustrates a type of compressive fastener that can be used with the shield of FIG. 1.

FIG. 2 illustrates a type of compressive fastener 200 that can be used with the shield 110 of FIG. 1. Compressive fastener 200 includes a rotatable metal cam-type wheel of approximately 1 and ½ inch diameter and ½ inch thickness, an off-center axial hole 214 for holding a 5/16 inch bolt(described in FIG. 8), an approximate ¼ inch opening 226 for an adjusting rod 224 of approximately 1 and ½ inches long, and a flat side portion 212 of approximately ¾ inch length which is used for locking the shield 100 in place whose operation will be described later. The material used for forming the compressive fastener 200 can include aluminum, galvanized steel and the like.

FIG. 3 illustrates a view of the fastener 200 of FIG. 2 attaching the shield 100 to the window 10 of FIG. 1. The flat side portions 212 of the fasteners 200 abut against an edge of the flange frame 120 at the points where the reinforcement channel members 130, 140 and 150 meet the flange frame 120.

FIG. 4 illustrates a cross-sectional view along line 4 of FIG. 3. Reinforcement channel 130 includes an approximate ½ inch lip portion parallel to pane backing 110 which is connected to an approximate 1 and ½ inch side portion 133 which extends at a 45 degree angle to flat portion 134 of approximately 1 inch length. Flat portion 134 is parallel to pane backing 110 and is connected to another side portion 135 which is also approximately 1 and ½ inches long and is connected to a lip portion 136 of an approximate ½ inch length. Lip portions 132 and 134 are fastened to pane backing 110 by soldering, welding, riveting, bolting or the like 131. Similarly reinforcement member 140 comprising components 142, 143, 144, 145 and 146, are connected to pane backing 110 in a like manner. Further reinforcement member 150 including components 152, 153, 154, 155 and 156 are connected to pane backing 100 in a like manner. FIG. 5 illustrates a cross-sectional view along line 5 of FIG. 3, wherein the compression fastener 200 is shown in an attach position.

Figure 8:
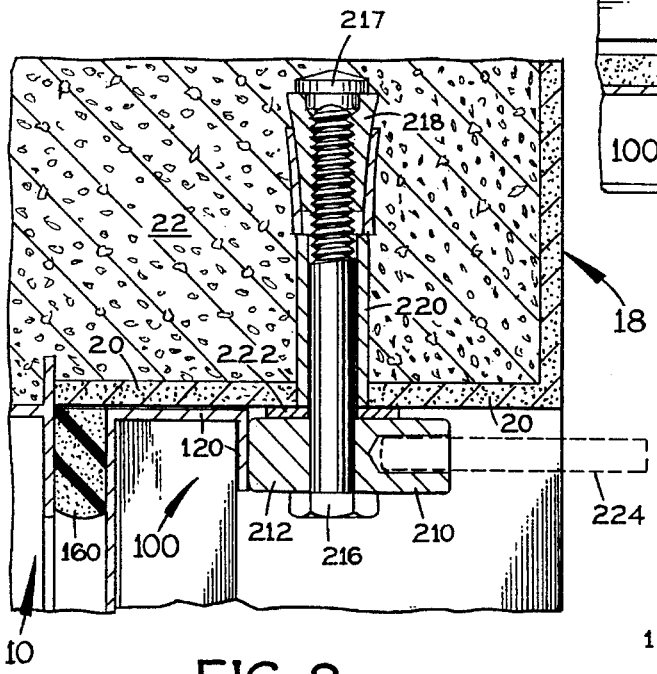
FIG. 8 illustrates a cross-sectional view of the compressive fastener of FIG. 2 connected to a wall.
Figure 9:
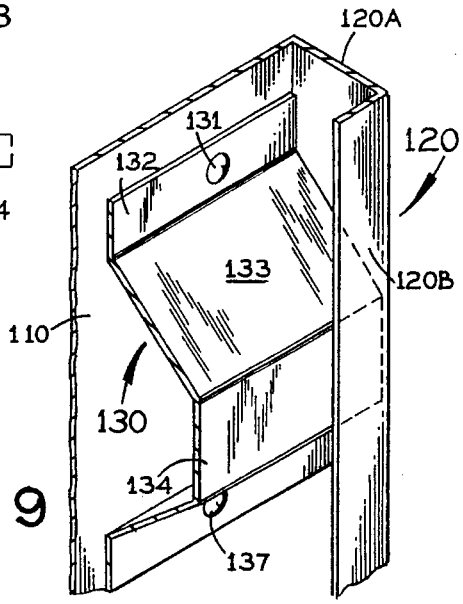
FIG. 9 shows an enlarged view of a reinforcement member and flange frame of the shield of FIG. 1.

FIG. 8 illustrates a cross-sectional view of the compressive fastener 200 of FIG. 2 connected to the second interior side frame wall 18. A 5/16 inch bolt 216 holds wheel 210 of compressive fastener 200 in place. Metal concrete anchor 218 includes threads that are mateable to threads on bolt 216. Anchor 218 is positioned within concrete wall 22. A metal sleeve 220 circles about bolt body 216 and a flat washer 222 is situated between wheel 210 and drywall 20. FIG. 9 shows an enlarged view of a reinforcement member 130 and flange frame 120 which includes portions 120A and 120B connected to pane backing 110 of the shield 100 of FIG. 1.

A preferred method of using the shield 100 with a typical window will now be discussed in reference to the above figures. With reference to FIG. 1, shield 100 can be first placed over a window 10 that is to be protected in order to determine the locations for positioning compressive fasteners 200. Markings for holes 217 shown in FIG. 1 can be made on second interior window frame 18 approximately ¾ inch from the flat portions 134, 144 and 154(FIG. 4) of the channel members 130, 140 and 150 by pencil, pen or the like. Once the markings are made, shield 100 can be removed and holes 217 can be drilled into the second interior window frame 18 through drywall 20 and into concrete base 22. See FIG. 8. Concrete anchors 218 can then be inserted within the holes 217. The concrete anchors 218 can be left within holes 217 until the shields are needed for storm and/or security protection.

When the shields are needed to be put up, the shield 100 is placed within secondary interior frame 18 as shown in FIG. 1. Bolt 216 holding wheel 210 and metal sleeve 220 are then inserted within holes 217 and the bolt 216 is rotated into anchor 218 by a socket wrench or the like(FIG. 8). Adjustment rod 224 is then inserted within opening 226 of wheel 210.

FIG. 4 shows the two positions of compressive fastener 200. Element 224A shows an initial position for the adjustment rod 224. The rod 224 is rotated down to position 224B to lock the compressive fastener 200 in place. As the rod 224 is rotated, gasket 160 (see FIG. 5) is compressed and forms a watertight seal between the shield 100 and window 10. In the lock position, the flat portion 212 of compressive fastener 200 is flush against flange frame 120 at the area 120B shown in FIG. 9. To remove the shield 100, the adjustment rod 224 is rotated in reverse to the steps mentioned above.

SECOND EMOBDIMENT.

Figure 6:
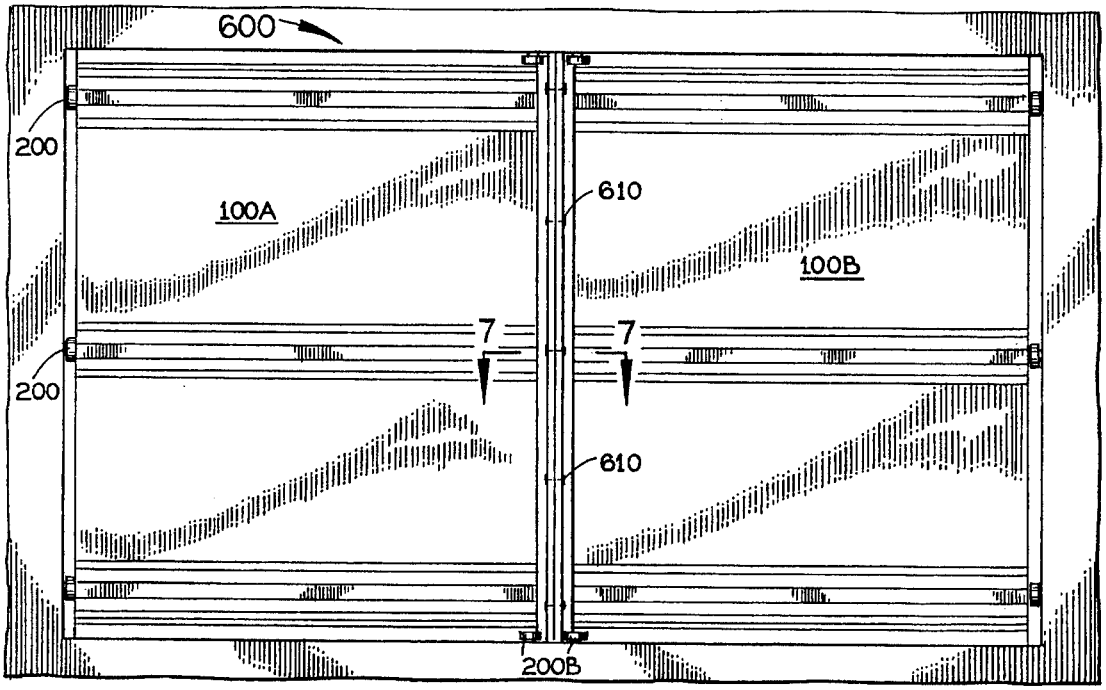
FIG. 6 illustrates a second embodiment of the invention using the inside shields for double windows.
Figure 7:
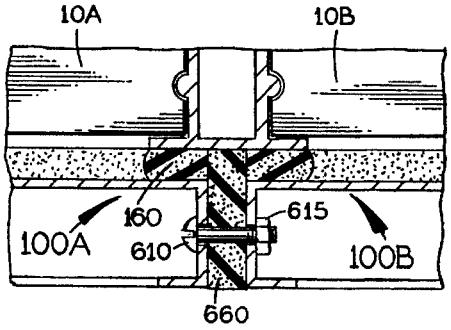
FIG. 7 illustrates a cross-sectional view along line 7 of FIG. 6 of the second embodiment.

FIG. 6 illustrates a second embodiment 600 of using the inside shields 100A and 100B for double windows 10A and 10B. Typically double windows 10A and 10B can be two 37 by 50 inch windows arranged side by side. FIG. 7 illustrates a cross-sectional view along line 7 of FIG. 6 of the second embodiment 600. Shields 100A and 100B contain the same components as interior shield 100 described in the first embodiment with additional features. Shields 100A and 100B are fastened together with a bolt or screw 610 and nut 615 through a separator material 660, which can be a gasket material such as component 160 described previously or of a more solid material such as wood, aluminum, or steel or the like which has been described previously as the types of material that form the shield 100. Several connecting fasteners 610 can be used to hold shields 100A and 100B together. Five fasteners 610 are shown but any number can be used as desired. Further, additional compressive fasteners 200B can be incorporated to help stabilize shields 100A and 100B in place.

The method of positioning, attaching and detaching the shields 100A and 100B in relation to windows 10A and 10B would be similar to that used in the first preferred embodiment.

THIRD EMBODIMENT

Figures 10, 11, 12, 13:
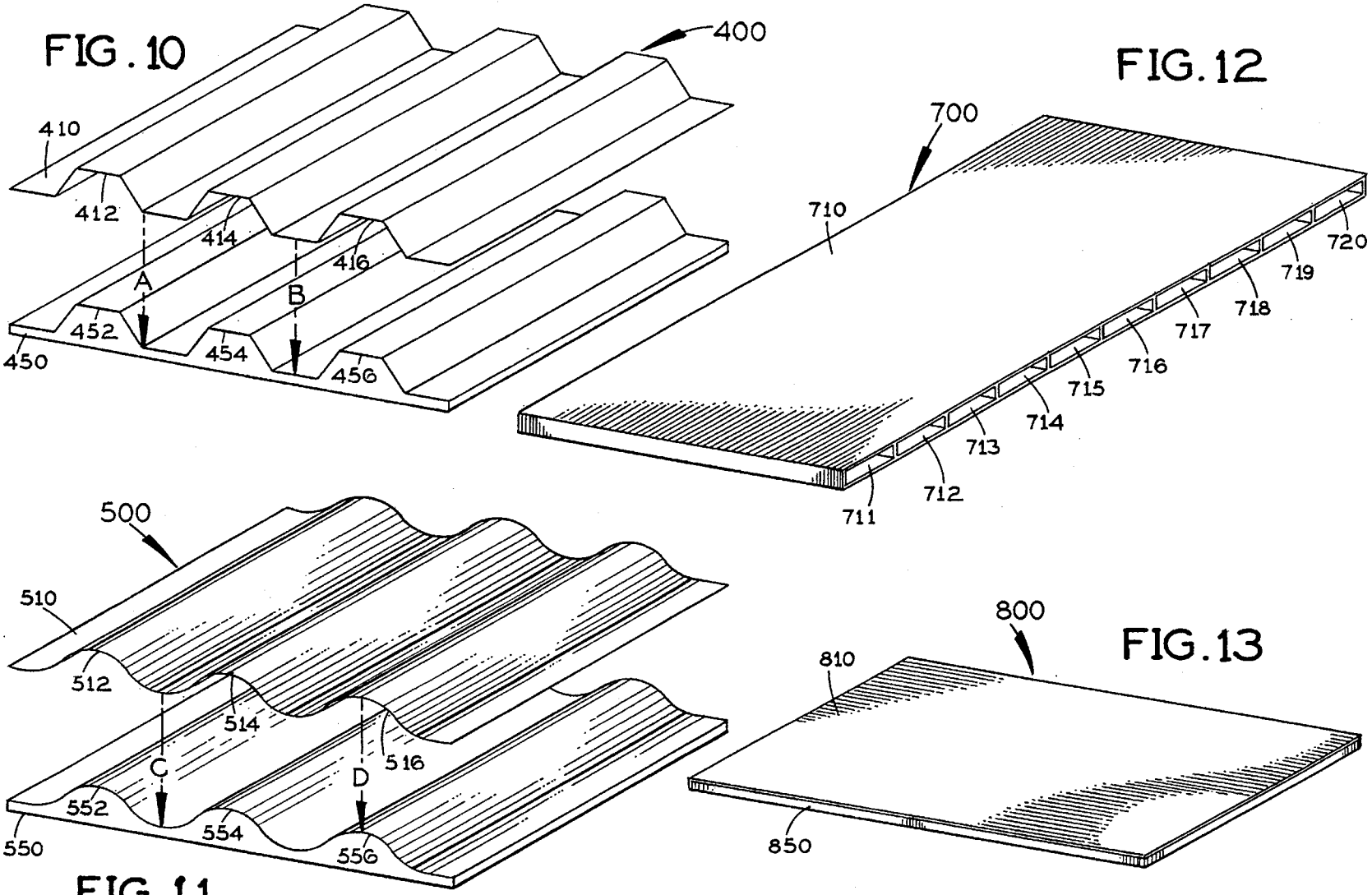
FIG. 10 shows an exploded side view of an alternative raised corrugated metal shield panel which can be used in place of the shield in FIG. 1.
FIG. 11 shows an exploded side view of a still another alternative metal shield panel with a surface having parallel curved indentations which can be used in place of the shield in FIG. 1.
FIG. 12 shows a side view of a still another alternative shield panel formed from extruded corrugated plastic which can be used in place of the shield in FIG. 1.
FIG. 13 shows a side view of a still another alternative fiberglass layer shield panel which can be used in place of the shield in FIG. 1.

A third embodiment illustrated in FIGS. 10–13 includes overlaying novel shield panels that do not have side flanges nor reinforcing members. FIG. 10 shows an exploded side view of an alternative raised corrugated metal shield 400 which can be used in place of the shield 100 shown in FIG. 1. Referring to FIG. 10, alternative shield 400 includes a roll formed corrugated metal panel 410 with indentations 412, 414, 416 which are shaped to fit over raised protrusions 452, 454, 456 of a seal-gasket backing 450. The shape of backing 450 can be formed from a mould and the like. Metal panel 410 can be made from but not limited aluminum, galvanized metal, and stainless steel. Panel 410 can be adhered to backing 450 by means such as but not limited to glue, cement and the like. Shield 400 can be used as substitute for shield 100 of the preceding FIGS. 1–9 and can be mounted in a like manner.

FIG. 11 shows an exploded side view of a still another alternative metal shield 500 which can be used in place of the shield in FIG. 1. Referring to FIG. 11, alternative shield 500 includes a panel 510 having parallel curved surface indentations 512, 514, 516 which is mounted to matching raised curved portions 552, 554, 556 of a seal-gasket backing 550. Parallel curved surface indentations 512, 514, 516 can be formed from techniques such as but not limited to roll formed. The shape of backing 550 can be formed from a mould and the like. Metal panel 510 can be made from but not limited aluminum, galvanized metal, stainless steel and the like. Panel 510 can be adhered to backing 550 by means such as but not limited to glue, cement and the like. Shield 500 can be used as substitute for shield 100 of the preceding FIGS. 1–9 and can be mounted in a like manner.

FIG. 12 shows a side view of a still another alternative shield 700 which can be used in place of the shield in FIG. 1. Referring to FIG. 12, shield 700, including panel 710, can be formed from techniques such as but not limited to plastic extruding and the like to form an extruded corrugated plastic panel with hollow portions 711 through 720. Shield 700 can be used as substitute for shield 100 of the preceding FIGS. 1–9 and can be mounted in a like manner.

FIG. 13 shows a side view of a still another alternative shield 800 which can be used in place of the shield 100 in FIG. 1. Referring to FIG. 13, shield 800 includes fiberglass layer 810 which overlies and is sealed to seal-gasket backing layer 850 by means such as but not limited to glue, cement and the like.

The types of structures that can be protected with the shields can be made of various types such as but not limited to CBS(concrete block construction), and wood frame. The structures themselves can be one story or multistory.

In wooden frame structures, a 5/16 inch lag screw bolt can be substituted for the bolt 216 of the compressive fastener 200, to hold the shields in the frames of the windows.

The units and measurements described herein are only for illustrative purposes only. The inside shields can be constructed to be of variable sizes for application to various window and door sizes. The inside shields can further be used for protecting any opening to a structure such as but not limited to windows, doorways, archways, etc.

The materials used for the shields can be of various types such as but not limited to aluminum, galvanized steel, stainless steel or the like.

While the invention has been described in an example for protecting windows of a homeowner, the invention can be equally applied to protecting commercial structures.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. A reinforced protection shield apparatus for the inside of a window in a highrise multistory building, the shield preventing effects of storms from passing into the building, comprising:

a window in a highrise multistory building having a glass pane within a window frame, the glass pane having an interior side and an exterior side;

a shield panel having reinforcement means for protection against storms, the shield panel being positioned over the interior side of the glass pane; and rotatable compression fasteners having an anchor portion fixably attached through the window frame and into a surrounding wall, the compression fasteners having a first position rotatable to a second position, wherein rotating each of the compression fasteners from the first position to the second position compresses the shield panel against the glass pane and rotating each of the compression fasteners back to the second position detaches the shield panel from the glass pane.

2. The protection shield apparatus of claim 1, further comprising:

sealing material on the side of the shield panel facing the interior side of the glass pane.

3. The protection shield apparatus of claim 1, wherein each of the rotatable compression fasteners further includes:

a cam wheel rotatably mounted about a bolt having threads, wherein the bolt is locked through the window frame and into the surrounding wall by the threads.

4. The protection shield apparatus of claim 3, further comprising:

a metal sleeve anchor within a concrete surrounding wall, the metal sleeve anchor having threads which are mateable to the threads of the bolt.

5. The protection shield apparatus of claim 1, wherein the shield panel reinforcement means includes:

a corrugated metal panel.

6. The protection shield apparatus of claim 1, wherein the shield panel reinforcement means includes:

a metal panel with a surface having parallel curves.

7. The protection shield apparatus of claim 1, wherein the shield panel reinforcement means includes:

an extruded corrugated plastic panel.

8. The protection shield apparatus of claim 1, wherein the shield panel reinforcement means includes:

a sheet moulded fiberglass panel.

9. The protection shield apparatus of claim 2, wherein the sealing material is formed from:

a gasket material.

10. A method for protecting a window in a highrise multistory building having a first inside frame about the periphery of the window, comprising the steps of:

(a) placing periphery edges of one side of a nonglass storm protection shield panel onto an inside frame of a window in a multistory building, the frame being mounted to a surrounding wall;

(b) positioning compression fasteners adjacent inside edges of the nonglass storm protection shield panel, the compression fasteners each being rotatably connected to coupling means;

(c) securing the coupling means through the inside frame of the window and into the surrounding wall; and (d) rotating the compression fasteners to a second side of the nonglass storm protection shield panel which is opposite to the first side, to cause the nonglass storm protection shield panel to compress against and substantially close against the window.

11. The method for protecting a window of claim 10, wherein the securing step includes:

rotating threads of bolts into mateable threads of concrete wall anchors.

12. The method for protecting a window of claim 10, wherein the rotating step includes:

compressing sealing material between the shield panel and the inside frame of the opening.

13. The method for protecting a window of claim 12, wherein the sealing material is formed from a gasket material.

14. The method for protecting a window of claim 10, wherein the rotating step includes:

rotating compression fasteners that include a cam wheel and the coupling means includes a threaded bolt, wherein the wheel rotates from a detach position to an attach position.

* * * * *